United States Patent [19]

Berg

[11] 4,195,820

[45] Apr. 1, 1980

[54] PRECISE THERMAL PROCESSING APPARATUS

[75] Inventor: Charles A. Berg, Buckfield, Me.

[73] Assignee: Pyreflex Corporation, Buckfield, Me.

[21] Appl. No.: 21,266

[22] Filed: Mar. 16, 1979

Related U.S. Application Data

[63] Continuation of Ser. No. 895,147, Apr. 10, 1978, abandoned.

[51] Int. Cl.[2] ..... C21D 1/34; C21D 1/74

[52] U.S. Cl. ..... 266/87; 13/25; 13/31 R; 219/390; 266/78; 266/250

[58] Field of Search ..... 266/78, 87, 250, 25 L; 13/20, 25, 31; 219/390

[56] References Cited

U.S. PATENT DOCUMENTS

| | | | |
|---|---|---|---|
| 2,375,154 | 5/1945 | Volterra | 13/25 X |
| 3,038,987 | 6/1962 | Dow et al. | 219/343 |
| 3,160,404 | 12/1964 | Potenzo et al. | 13/31 X |
| 3,240,915 | 3/1966 | Carter et al. | 219/343 |
| 3,260,783 | 7/1966 | Potenzo et al. | 13/31 |
| 3,626,154 | 12/1971 | Reed | 219/411 |
| 3,736,360 | 5/1973 | Bergman et al. | 13/24 |
| 3,737,553 | 6/1973 | Kreider et al. | 13/25 |
| 3,846,574 | 11/1974 | Rordorf | 13/31 |

*Primary Examiner*—F. C. Edmundson
*Attorney, Agent, or Firm*—Kenway & Jenney

[57] ABSTRACT

Disclosed is apparatus for subjecting a workpiece to a controlled temperature comprising a light-weight muffle of high diffusivity material having an interior high emissivity surface, an air cooled envelope surrounding the muffle having an infrared reflective interior surface, and a housing which maintains a vacuum in the space outside of the muffle. Heaters and temperature sensors are spaced about the muffle. The heaters are controlled by an electronic feedback control system which actuates the heaters in response to signals received from the temperature sensors. The apparatus is ideally suited for use in the controlled diffusion processing techniques employed in the fabrication of electronic devices because it applies on the order of 90% of the generated heat to the workpiece, can be rapidly heated up and cooled, and can maintain a selected temperature within narrow limits.

8 Claims, 3 Drawing Figures

PRECISE THERMAL PROCESSING APPARATUS

This is a continuation of application Ser. No. 895,147, filed Apr. 10, 1978, now abandoned.

BACKGROUND OF THE INVENTION

This invention relates to apparatus for processing materials at elevated temperatures characterized by efficient use of energy and precise temperature control.

In many industrial processes involving the heat treatment of metals, the material must be heated to a selected high temperature and maintained at that temperature for a prescribed time. Sensitive thermochemical processing techniques such as those involving controlled diffusion in semi-conductor materials necessitate very precise temperature control. For example, the processing of electronic materials for gas discharge displays typically requires a heat treatment step wherein the temperature of the material must be kept within about $\pm 1°$ C. Failure to attain this precision results in a loss of quality control in the diffusion process and in insufficient reliability to afford the yields required in successful commercial production. The more precisely the temperature of a processing furnace can be maintained, the more reliable the thermal processing and the higher the yield of products. Thus, although state of the art furnaces afford control in the range of 5° C. to 1.0° C., further improvements enabling temperature control on the order of $10^{-1}$° C. to $10^{-3}$°C., would be of significant commercial value.

Currently available diffusion furnaces rely for precise operation on the presence of a large quantity of stored heat which acts as a "thermal buffer". These furnaces comprise an array of massive ceramic insulating blocks which surround a hollow muffle, typically made of stainless steel, which in turn encloses the material to be processed. The blocks are heated by thermostatically controlled resistance heaters (or similar devices). They tend to establish thermal equilibrium with the muffle by transferring heat thereto via radiation, convection, and conduction. The interior surface of the muffle then radiates to the material being processed.

The main advantage of the "thermal mass" type diffusion furnace described above is that it affords an inexpensive means of controlling temperature, generally within limits of $\pm 1°$ C. Such precision is attainable because the large amount of heat stored in the ceramic mass acts as a thermal buffer to moderate effects tending to alter the thermal environment of the muffle itself. However, this approach to furnace construction can rarely provide levels of control more refined than about $\pm 1°$ C. This is because the heat is stored as "sensible heat". When called upon to buffer the effects of a thermal disturbance, the hot ceramic mass either absorbs or gives up some of the stored heat. This of course necessarily results in a change of temperature of the ceramic itself, and thus of the muffle and workpiece, but because of the quantity of heat present in the ceramic mass, a large external loss or gain results in only a small change in the temperature of the muffle or the workpiece. Thus, the thermal storage approach reduces the effect of external disturbances of the thermal environment, but cannot eliminate these effects.

From the foregoing it is obvious that the larger the stored thermal mass, the less a given heat gain or loss will influence the temperature of the muffle. However, capital costs and requirements of efficient energy use effectively prohibit very large furnaces from being economical, because once a thermal mass furnace has attained a given steady-state operating condition, it must be run substantially continuously, irrespective of the frequency of its use. It can be shut down for maintenance only rarely. The reason for this is that the time necessary to obtain steady-state operating conditions is generally too long to allow the unit to be cycled. Furthermore, cycling creates the risk of losing the desired thermal condition, and with it part or all of a day's production. In practice, these furnaces accordingly remain energized twenty-four hours a day, seven days a week.

To control the temperature of the workpieces contained within a thermal mass furnace, it is necessary and only necessary to regulate the temperature of the muffle. Thus, the temperature distribution on the muffle completely determines all thermal aspects of the processing steps. At the temperature required in the processes discussed above (typically 500° C. or more), by far the most important mechanism of heat transfer is radiation. At 500° C., the radiant heat flux from a stainless steel surface having an emissivity of 0.9 will be approximately 6,000 BTU/hr. $ft^2$. If this material is radiating to a background of high emissivity (e.g., greater than 0.7) at, for example, 35° C., the return of radiation from the background to the surface will be negligible.Since natural convection can remove only about 1,000 BTU/hr. $ft^2$ from steel, at least about 88% of the heat loss from steel occurs by radiation at temperatures of 500° C. or above. Accordingly, in the context of the diffusion furnace, both natural convection and conduction can be neglected as an insignificant method of heat transfer between the muffle and workpiece when compared with the rapid and efficient radiative transfer.

Thus, since the most important aspect of thermal interaction between the muffle and the material being processed is radiation, control of this mechanism of heat exchange is most important. Similarly, the most important mechanism of heat loss from the muffle is radiation, and again, radiation is the most important mechanism to control. (Convection within the muffle must, of course, be controlled to prevent local variations of temperature. This is done by conventional means.)

SUMMARY OF THE INVENTION

The instant invention provides a novel type of apparatus for maintaining a workpiece at a selected precise temperature. The apparatus comprises a light weight muffle of material having a high thermal diffusivity and an interior surface characterized by high emissivity. An envelope having an interior surface that is reflective to the infrared completely encircles the muffle. A housing surrounds the envelope and contains a vacuum in the space between the muffle and housing. Heater means and temperature sensing means are placed in thermal communication with the muffle; electronic means is provided for controlling the heat output of the heaters in response to signals received from the temperature sensors.

With the furnace construction of the invention, the muffle's convective or conductive heat losses (which can represent as much as 12% of its total heat loss) are eliminated; its radiant environment is controlled with the reflective envelope. The electronic controls, lightweight muffle of high thermal diffusivity and infrared reflective envelope are used in combination to enable one to maintain a selected muffle temperature with high precision. In general, the muffle temperature may be controlled at least as precisely as in the thermal storage type furnaces described above, and certain embodiments of the apparatus of the invention are able to maintain a temperature with a precision equal to or greater than $\pm 10^{-2}$° C.

In preferred embodiments, the muffle is made of stainless steel and is less than about 0.1 inch thick. Optimally, the muffle should be just strong enough to withstand the vacuum applied to its exterior and the temperatures to which it is subjected. A conduit communicates between the interior of the muffle and the exterior of the housing for providing atmospheres of controlled composition and pressure to the workpiece holding space within the muffle. The heater means preferably comprises one or more electrical resistance heaters fixed to or made an integral part of the exterior surface of the muffle. The preferred temperature sensing means comprise a plurality of thermocouples spaced about the muffle.

Since no reflective surface has a reflectivity of 100 percent, a certain fraction (typically less than 2%) of the IR radiation impinging on the envelope will be absorbed as heat. Thus, the envelope must be cooled. This can be done by providing a thermal conductive link between the envelope and the housing, for example, by using the housing as the substrate for the infrared reflective surface. Alternatively, the envelope may be cooled by providing it with an emissive outside surface and providing an emissive interior surface on the housing, thereby providing radiative coupling between the envelope and housing. The preferred cooling means comprises cooling coils mounted in thermal communication with the body of the envelope.

It is accordingly an object of the invention to provide a furnace for maintaining a workpiece at a selected precise temperature which is energy efficient and capable of more precise control than is presently possible in the known thermal storage type furnace. Other objects are to provide a furnace having a muffle isolated such that heat loss by convection or conduction is minimized or eliminated and to provide a furnace characterized by low thermal inertia and essentially zero heat storage. Another related object is to provide a furnace which may be turned off when not in use for a short period, and later turned back on and brought to operating conditions in a short time.

These and other objects and features of the invention will be apparent from the following description of some preferred embodiments and from the drawings.

BRIEF DESCRIPTION OF THE DRAWINGS

Like reference characters in the respective figures indicate corresponding parts.

DESCRIPTION OF THE PREFERRED EMBODIMENT

Figure 1:
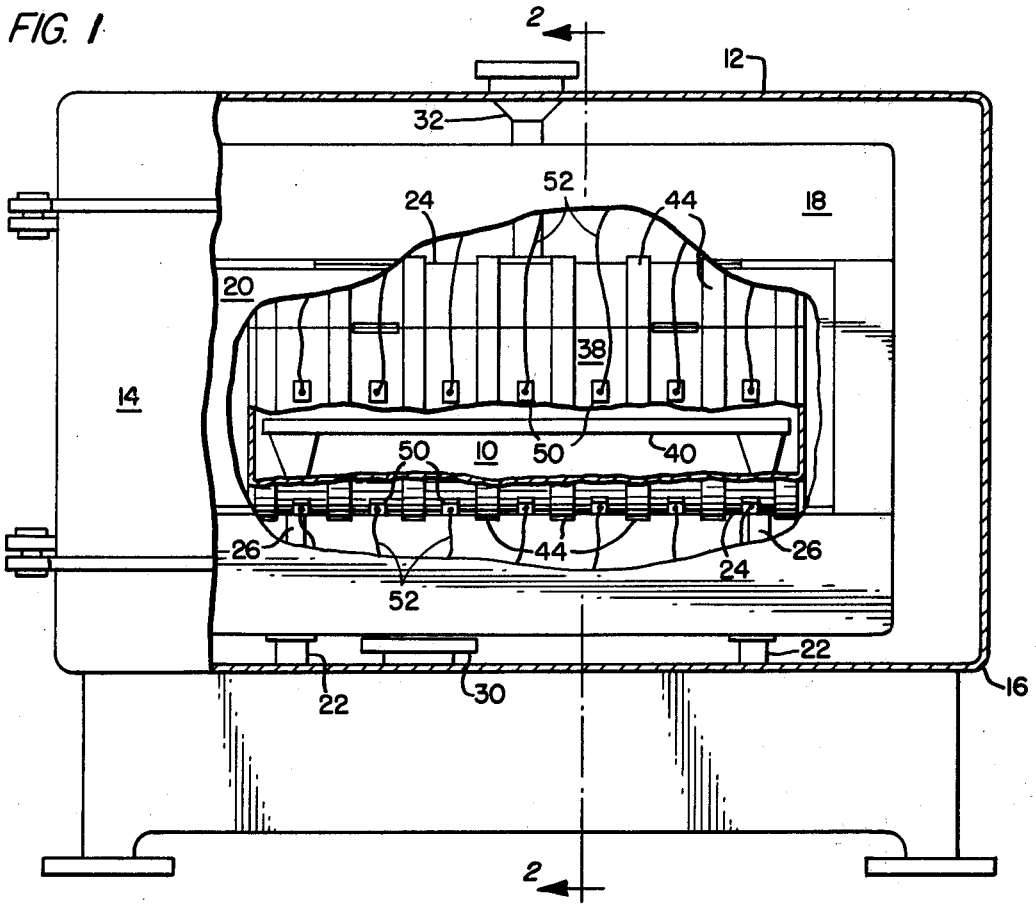
FIG. 1 is a partly broken away schematic, front elevation of a furnace embodying the invention.

The apparatus of the invention is capable of maintaining a workpiece at a given precise temperature and of heating a workpiece at a controlled rate because of the combination of three fundamental construction features. Specifically, the construction of the muffle, the structural environment of the muffle within the furnace, and the unique temperature sensing and heating means are used in combination to attain the advantages of the invention as set forth in detail below.

The muffle is constructed of a material having a high thermal diffusivity, and is characterized by a high emissivity interior surface. The approach involves fabricating the muffle of a thin, light material so that essentially zero heat is stored, and the muffle is capable of rapidly eliminating heat gradients formed in its structure by thermal diffusion and infrared radiation transfer. The presently preferred material for the muffle is stainless steel less than about 100 mils thick. To optimize the precision of the temperature maintainable in the furnace, the muffle should be made as thin and as lightweight as possible, bearing in mind that for most furnace applications it will be called upon to withstand pressures upwards of 14 psi and temperatures upwards of 500° C. In apparatus designed for heating workpieces under a vacuum, the muffle may be made of extremely thin material since the pressure on its opposite sides will be the same. It is believed that best results will be obtained when the muffle is made of an inert metal on the order of 0.01 inch thick and having a diffusivity of 0.27 $ft^2$/hr. or more.

The structural environment of the muffle is designed to minimize heat transfer from the muffle to anything other than its interior and the workpiece it contains. Convective heat losses are eliminated by evacuating the space exterior to the muffle. Conductive heat losses are minimized by employing low thermal conductivity material in the necessary support structure which holds the muffle in position and by other design features. Radiative heat loss, which is the mechanism by which essentially all of the heat will be lost from the muffle under the conditions described above, is minimized by enclosing the muffle in an envelope having a highly reflective interior surface. It is currently within the skill of the art to produce infrared radiation reflective coatings on any one of a large variety of substrate materials that will exhibit a reflectivity greater than 97%. Coatings are currently available, e.g., gold films protected with an infrared transparent metal oxide coating such as titanium oxide, which are capable of remaining at 98% reflectivity for extended periods (even in air at 500° C.). These can also withstand repeated cleanings. It is especially advantageous that the reflective coating used on the interior surface of the envelope in the apparatus of the instant invention is located in a vacuum and thus resists degradation.

In combination with these features, one or more heaters, preferably electric heaters such as resistance heaters of infrared lamps (but in any case devices which are capable of precise thermal control) are provided in contact with, or slightly spaced apart from, the exterior surface of the muffle. The thermal output of the heater or heaters is controlled by an electronic feedback system which samples the temperature of the muffle through temperature sensing devices such as thermocouples, and employs the incoming signals to control heater output.

The principal limitations on the precision with which the temperature of the muffle may be regulated are:

1. The precision with which the temperature of the surface of the muffle can be measured;

2. The speed with which electronic controls can react to a change in the sensed temperature;

3. The speed with which power input can be applied to the heating elements; and

4. The rate at which the temperature of the muffle can respond to changes in power input.

Regarding the first limitation, it will be appreciated that devices presently exist which are capable of measuring temperature with almost arbitrary precision, e.g., commercially available calibrated thermocouples or thermopiles are capable of measuring temperature with a precision of $10^{-1}$° C. to $10^{-3}$° C. The limiting factors on points two and three are the speed with which changes in muffle temperature can be sensed and the speed of the thermal response of the heaters to a given power input. Again, both of these are so rapid that they need not be considered further. Regarding factor four, the speed of thermal response of the muffle depends entirely upon its mass, the spacing of the heaters, and the characteristic thermal diffusivity of the material from which it is made. Accordingly, it is preferred that a plurality of heaters spaced about the muffle be employed, and that the mass of the muffle be as small as possible.

For transmission of the thermal signal over distance d into a material having thermal diffusivity a, the time t required is: $t=d^2/a$. Since, for 430 stainless steel, $a\approx 0.27$ ft$^2$/hr. it may be seen that for a muffle having a wall thickness of 10 mils, thermal diffusion across the wall will occur in about 0.1 second. Given this response, it should be possible to control the temperature of the interior surface of the muffle with the same precision as that of the outside surface, i.e., to within about ±0.1° C. to ±0.01° C., provided one uses suitably sensitive temperature sensors and electronic controls, which are currently available.

The only significant mechanism for heat loss from the outside of the muffle is through thermal radiation. However, infrared radiation emitted from the exterior surface of the muffle or the electric heaters is reflected by the infrared reflective coating on the interior of the envelope surrounding the muffle. Such radiation may return directly to the muffle or it may undergo several reflections before returing. While proper construction of the interior surface of the envelope can minimize the number of reflections which occur (see copending U.S. application Ser. No. 663,370, filed Mar. 3, 1976 entitled "Heat Recuperator", the disclosure of which is incorporated herein by reference), as a "worst case" example, it will be assumed that thermal radiation from the muffle or heaters must undergo an average of 5 reflections before returning to the muffle. In this situation, if the reflectivity of the interior surface of the envelope is 98% (easily obtained by current coating techniques), then the strength of the reflected beam returning to the muffle would be $(0.98)^5$ or 90.4% of the strength of the emitted beam. Thus, on the average, the effective emissivity of the envelope would be $1.0-0.904=0.096$; the effective emissivity of the muffle would be at least about 0.90. On the basis of these assumptions, it may readily be calculated that the infrared reflective interior surface of the envelope will reduce the radiant heat loss from the muffle to a maximum of about 9% of the black body radiant flux emitted at the temperatures of interest.

The small amount of heat absorbed by the envelope must be dissipated; otherwise the muffle and reflective envelope will eventually reach thermal equilibrium, resulting in possible thermal degradation of the envelope structure.

Figure 2:
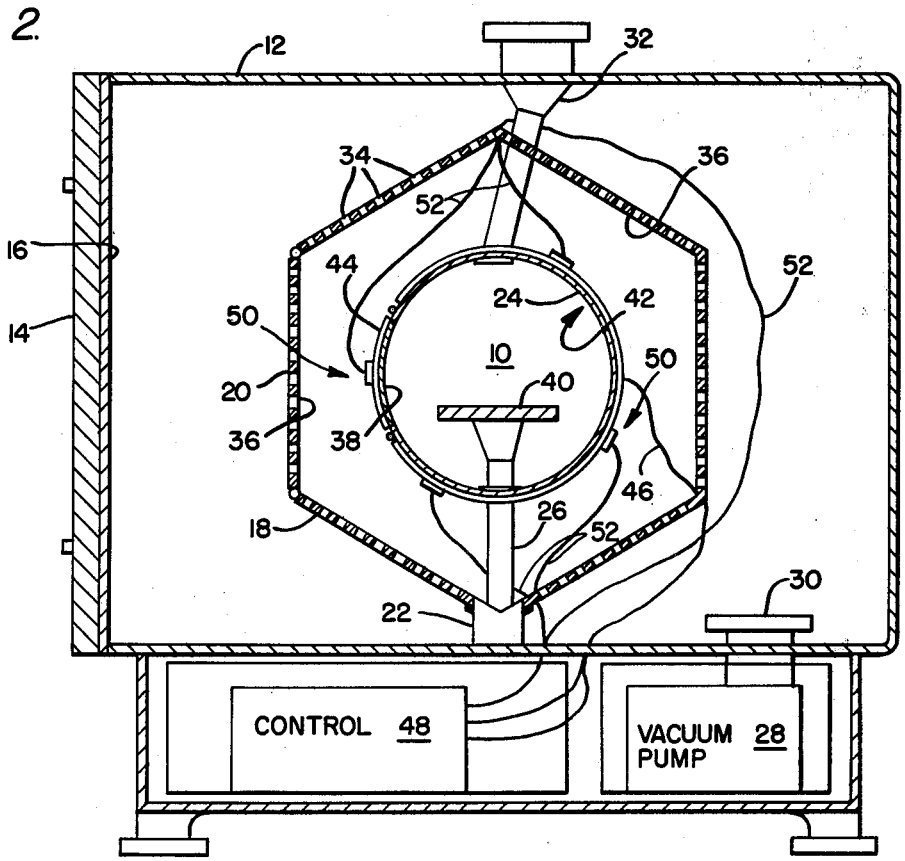
FIG. 2 is a cross-section of the furnace of FIG. 1 taken at lines 2—2.

Referring to the drawing, FIGS. 1 and 2 schematically illustrate a furnace embodying the invention wherein access to a cylindrical workpiece holding space 10 is provided by a series of doors arranged radially to the central axis of the holding space. The apparatus comprises a housing 12 having a door 14 which, when closed, forms a seal with the housing in engagement with elastomeric bead 16. An elongated, hexagonal cross-section envelope 18 having a hinged door 20 is mounted on supports 22 within housing 12. An enclosed, cylindrical muffle 24 of sheet stainless steel is mounted on supports 26 coaxially with envelope 18 and has a sealable access door 38. A means for producing a vacuum such as pump 28 communicates via pipe 30 with the interior of the housing and serves to produce subatmosphereic pressures in the space bounded by the exterior of muffle 24 and the interior of housing 12. A conduit 32 communicates between the workpiece holding space 10 on the interior of the muffle 24 and the exterior of housing 12.

As shown in FIG. 2, the envelope 18 comprises a corrugated structure having a plurality of serpentine conduits 34 through which cooling fluid is forced by a pump of the like (not shown). The interior surface 36 of envelope 18 is provided with an infrared reflective coating such as vapor deposited gold which, preferably, is protected by an infrared transparent film, e.g., a film of an oxide of zirconium, titanium, or aluminum. To promote effective heat exchange between fluid passing through conduits 34 and envelope 18, the substrate for the reflective coating should preferably comprise a material having a high thermal conductance such as copper.

Muffle 24 has a sealable access door 38 and an interior workpiece support 40. Its interior surface 42 is characterized by high emissivity. A plurality of resistance type heating elements 44 are wound circumferentially about the muffle with an axial separation. Power is supplied to the heating elements through leads 46 which deliver current under the control of feedback control means 48. Lastly, a plurality of thermocouples 50 are spaced about the surface of muffle 24 and deliver a signal to control means 48 via leads 52.

Figure 3:
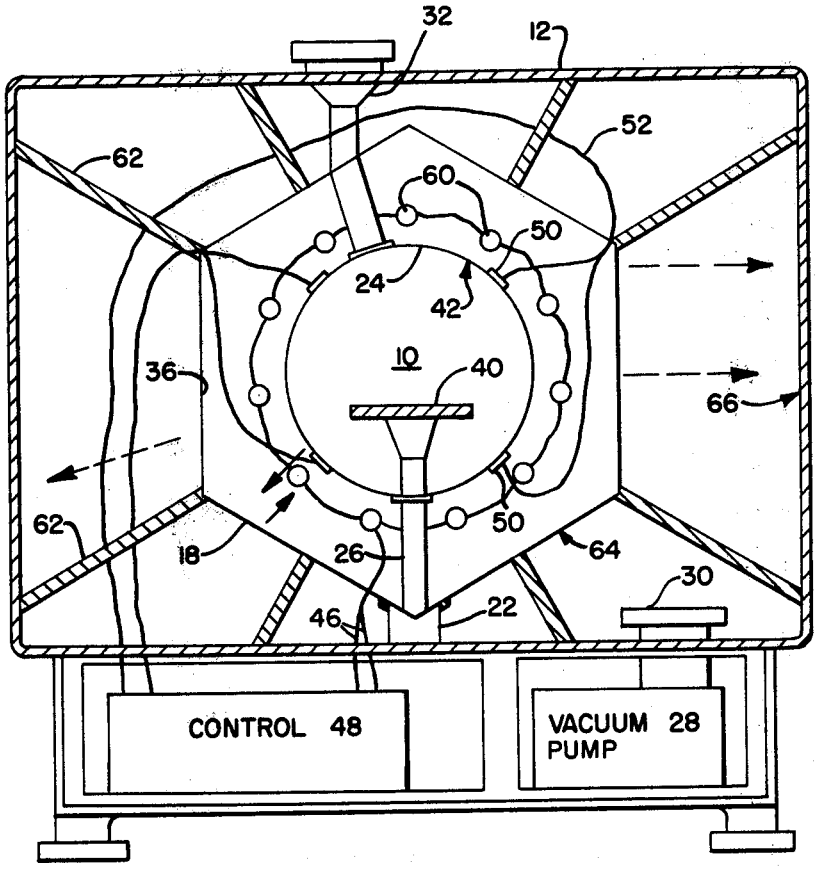
FIG. 3 is a schematic cross-section of a second furnace embodying the invention.

Referring to FIG. 3, a cross-section of a second furnace embodying the invention is shown. The embodiment of FIG. 3 is similar to that set forth in FIGS. 1 and 2 except for certain changes in the muffle heating means and the cooling means servicing the envelope 18. Specifically, in place of resistance heaters 44, a plurality of elongated infrared lamp heaters 60 are axially arranged about the circumference of muffle 24 and out of contact with the muffle. Instead of the corrugated structure of the envelope, the embodiment of FIG. 3 comprises an envelope which disposes of its accumulated heat by conduction to the housing 12 through a plurality of heat conducting support struts 62 and by emitting infrared radiation from its exterior surface 64 to the interior surface 66 of housing 12. High emissivity coating on the exterior of envelope 18 and on the interior of housing 12 will facilitate this mechanism of heat loss and form a radiative couple between the envelope and housing.

In operation, with a workpiece on support 40, a vacuum is drawn in the space between the exterior of the muffle 24 and the interior of the housing 12 by vacuum producing means 28. The muffle is then heated to a selected high temperature by energizing the heaters 44 (or 60). During the temperature rise, the interior surface 42, and to a lesser extent, the exterior surface of muffle 24, emit infrared radiation. Radiation emitted by interior muffle surface 42 is absorbed and used to raise the temperature of the workpiece and any atmosphere within space 10. As air within space 10 expands, it vents itself through conduit 32. The radiation emitted from the exterior surface of muffle 24 or outwardly from the heaters will impinge upon the interior infrared radiation reflective surface 36 of envelope 18. At least 90% of this radiation will be returned to the muffle. That portion of the energy absorbed by the envelope will be dissipated by cooling fluid passing through openings 34, or, in the case of the embodiment of FIG. 3, by radiation emitted from the exterior surface 64 of envelope 18 and absorbed by housing 12, and/or by conduction through struts 62.

When a selected workpiece temperature has been reached (as indicated by the signals from thermocouples 50), further energizing of the heaters 44 or 60 is controlled by feedback control means 48 so that the temperature of the muffle is maintained within precise limits. Thus, the workpiece and muffle exchange infrared radiation and quickly thermally equilibrate. A certain fraction of the infrared radiation emitted from the exterior surface of the muffle is lost to the body of envelope 18, this is removed at a constant rate by the cooling mechanism.

Shut down of the furnace is easily accomplished by terminating power to the heaters and continuing to cool the envelope.

Thus, it may be seen that the apparatus of the invention is capable of employing energy in an efficient manner and is easily started up and shut down. Furthermore, because of the interaction of the features as described above, an improved degree of thermal precision is possible.

From the foregoing it will be obvious that various modifications can be made in the apparatus without departing from the spirit or scope of the invention. Thus, it is contemplated, for example, that conduit 32 may be used to evacuate workpiece holding space 10 or to provide a controlled atmosphere within the holding space as dictated by the use to which the apparatus is to be put, and that various structural changes can be made further to improve the operation of furnaces constructed in accordance with the foregoing. Accordingly, other embodiments are within the following claims.

What is claimed is:

1. Apparatus for maintaining a workpiece at a selected precise temperature, said apparatus comprising:

a muffle of material having a high diffusivity defining an enclosed workpiece holding space, said muffle having an interior surface of high emissivity material;

an envelope surrounding and separated from said muffle and having an interior infrared radiation reflective surface;

a housing enclosing the muffle and said envelope;

means for evacuating the space bounded by the muffle and envelope;

means for removing heat from said envelope;

heater means and temperature sensing means in thermal communication with said muffle; and control means for adjusting the heat output of the heater means in response to signals received from the temperature sensing means.

2. The apparatus of claim 1 further comprising a conduit in communication with the workpiece holding space for providing an atmosphere thereto.

3. The apparatus of claim 1 wherein said means for removing heat comprise means disposed to form a thermal conduction link between the envelope and the housing.

4. The apparatus of claim 1 wherein said means for removing heat comprise an emissive outside surface of the envelope and an emissive interior surface of the housing, said emissive surfaces defining a radiative coupling of said envelope and housing.

5. The apparatus of claim 1 wherein said means for removing heat comprise cooling fluid conduits supported in thermal communication with said envelope.

6. The apparatus of claim 1 wherein said heater means comprise an electrical resistance heater and said temperature sensing means comprise a plurality of thermocouples spaced apart on said muffle.

7. The apparatus of claim 1 further comprising means for evacuating the space bounded by said muffle and said housing.

8. The apparatus of claim 1 wherein the muffle is constructed of sheet metal having a thermal diffusivity greater than about 0.27 $ft^2/hr$.

* * * * *